US008079206B2

(12) United States Patent
Abbasi

(10) Patent No.: US 8,079,206 B2
(45) Date of Patent: Dec. 20, 2011

(54) RING SPINNING MECHANISM WITH FIXED RING LOCATION

(76) Inventor: Abdul Latif Abbasi, Toronto (CA)

( * ) Notice: Subject to any disclaimer, the term of this patent is extended or adjusted under 35 U.S.C. 154(b) by 52 days.

(21) Appl. No.: 12/572,631

(22) Filed: Oct. 2, 2009

(65) Prior Publication Data

US 2011/0078992 A1 Apr. 7, 2011

(51) Int. Cl.
*D01H 7/52* (2006.01)

(52) U.S. Cl. ..... 57/75

(58) Field of Classification Search ..... 57/75
See application file for complete search history.

(56) References Cited

U.S. PATENT DOCUMENTS 5,694,757 A * 12/1997 Smekal et al. ..... 57/264
5,740,666 A * 4/1998 Yamaguchi et al. ..... 57/264
6,009,698 A * 1/2000 Dinkelmann et al. ..... 57/75
6,182,434 B1 * 2/2001 Kubovy et al. ..... 57/354

* cited by examiner

*Primary Examiner* — Shaun R Hurley
(74) *Attorney, Agent, or Firm* — Nasser Ashgriz

(57) ABSTRACT

A mechanism for spinning fibrous material to yarn employing the 'ring spinning process' on a powered ring frame unit. The device can be adjusted and fixed for the thread count in production. The spinning cone reciprocating up and down to take up the spun yarn, thus ensuring most optimum geometry between the drafting roller and the spinning ring, adjustable at will. Each spinning cone on the entire frame being independent of each other in drive, speed and distance from the drafting assembly. Computers using a new software control the entire process. The described mechanism reduces power consumption, mechanical vibration and material breakage, consequently increasing productivity of the process and quality of the product.

6 Claims, 4 Drawing Sheets

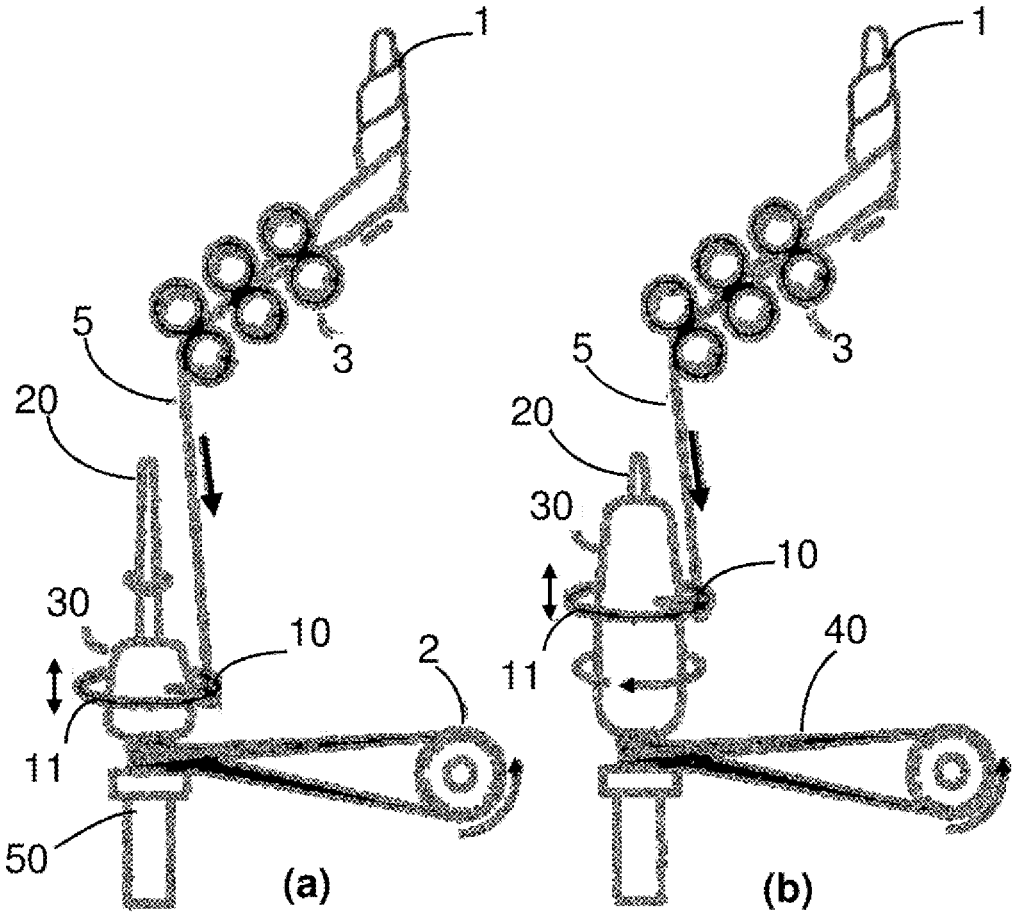
FIG. 1 – Prior Art

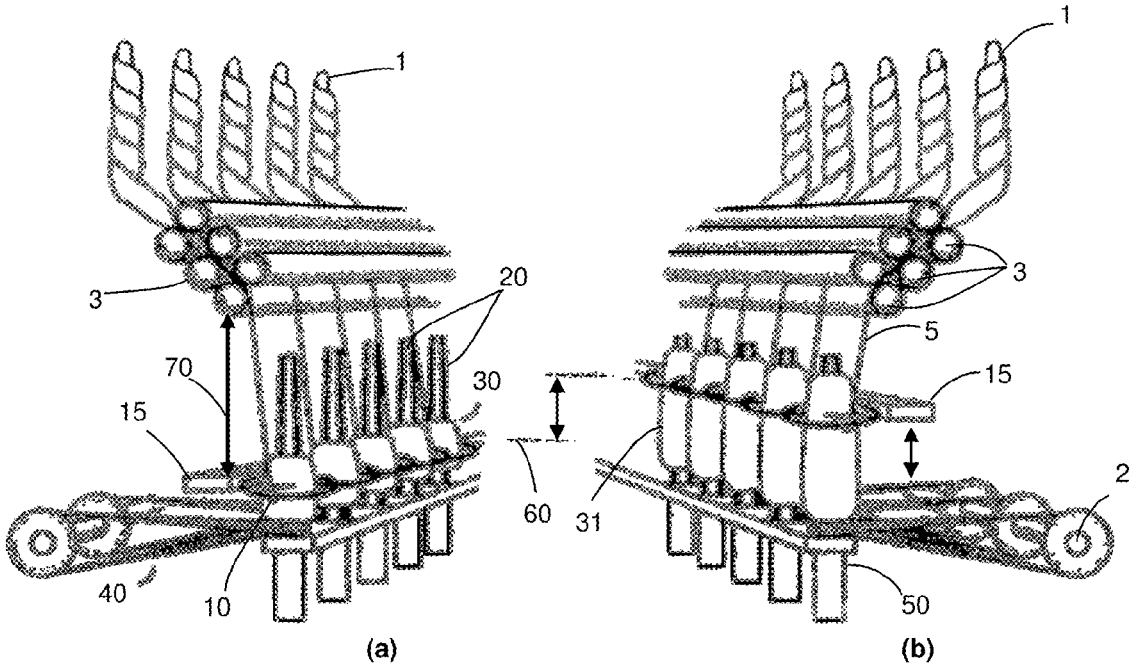
FIG. 2 – Prior Art

RING SPINNING MECHANISM WITH FIXED RING LOCATION

FIELD OF THE INVENTION

The present invention relates to the fiber spinning process employing individual motor driven spinning spindle units with a fixed distance between the spinning ring and the drafting-unit.

BACKGROUND OF THE INVENTION

Currently the spinning of yarn is achieved by rotating 'cones' at a high speed. Cones, which are set on spindles, are rotated by an electric motor that drives all the spindles on a frame. A frame can have up to 400 or more spindles on it. Drive shafts and rubber based belts are employed to spin the spindles. As a consequence of this spinning action, a passive 'ring' is made to rotate on its holding assembly, that actually puts the twist on the yarn. The twist is counted as 'TPI' or 'twists per inch'. Twist count on the yarn is achieved by the spinning action of the yarn while traveling between the drafting rollers and spinning ring, after which it is wound on the cone. At the start of this cycle, the spinning ring is at the lowest end of the cone, and as the cone begins to fill up, it travels up until it reaches the top of the cone where the cycle ends. This upward motion of the spinning ring is necessary in order to collect the spun yarn on the cone.

The main compromises in the system are: (a) All the spindles must rotate when the motor is turned on. (b) Distance between the spinning ring and the drafting roller can not be fixed due to the up and down reciprocation of the ring, which is absolutely necessary for the take-up of the yarn. This means that the most optimum spinning geometry cannot be achieved. (c) Since all spindles must be rotated and other tasks also performed, the main motor has to be of a high wattage. (d) In case of yarn breakage at one of the spindles, either the entire spinning frame must be stopped or that particular spindle may be abandoned or the yarn spliced on a running machine. (e) Due to these mechanical dictations at the start of the cycle the ring is at its farthest distance from the drafting assembly. All these design compromises affect the quality of the spun yarn.

U.S. Pat. No. 5,396,757 overcame certain disadvantages of traditional spinning mechanism by using a single motor to drive each spindle separately. The invention also discloses a method to control the jumping of the spindles. If there is yarn breakage at a given spindle, by this invention it is not necessary to stop the whole spindle assembly. Because each motor controls a single spindle, respective motor can be stopped and the damage can be fixed without negotiating the productivity.

U.S. Pat. No. 6,205,759 B1 also discloses individual spindle drive type textile machines where each motor drives a single spindle. Spindle units are arranged in parallel arrays. If one spindle unit gives trouble, there is no requirement to stop the entire spindle unit. This invention also discloses the use of a circuit box, which controls the speed of each spindle unit.

One objective of the present device is to reduce yarn breakage. In presently available systems, the spindle is fixed at a specific position and a spindle ring having a guide moves up and down along the spindle winding the yarn. At the start of the spinning process, when there is no yarn on the bobbin, the spindle ring lies at the bottom of the spindle. Therefore, initially, the distance between the ring and the rollers is large (because the spindle ring lies at the bottom of the spindle) and also the ring is not held firmly since there is no yarn on the bobbin. This increases the tension of the yarn, resulting in breakage of the yarn. Traditionally during the initial spinning process, the spindles are rotated slowly to avoid the breakage of the yarn. This slow initial spinning process reduces the productivity of the yarn wound onto the spool. Prior art has no efficient method for controlling the yarn breakage and also prior art has no efficient method for determining the number of twists and turns needed for optimum winding.

In these respects, the spindle spinning mechanism according to the present invention substantially departs from the conventional concepts and designs of the prior art, and in so doing provides a machine primarily developed for the purpose of yarn spinning and pre-determination of number of twists and turns which is controlled by a computer.

SUMMARY OF THE INVENTION

Accordingly, it is therefore, the first object of the present invention to provide a spindle assembly, which is capable of reducing yarn breakage and controlling the number of twists on the yarn more accurately in order to produce quality yarn.

It is other object of the present invention that the spindle oscillates reciprocally in order to collect the spun yarn whilst the spinning ring stays fixed during the entire spinning process at the most optimum geometry for that count of yarn. The spinning ring's geometry may be adjusted and fixed at the start of the cycle. It is other object of the present invention that a computer program can control the number of twists and turns.

Accordingly, it is other object of the present invention to provide a spindle assembly that is capable of rotating at higher speeds.

Another object of the present invention is to provide spinning machines where each spindle is rotated independently and can be stopped individually in order to attend to broken yarn or other needs.

Another object of the present invention is to provide a spinning machine with individual spinning units controlled by a computer. This allows for the control of the number of rotations of each spindle, control of the rotation speed of the spindle, as well as control of the number of twists and turns of the spindle.

Another object of the present invention is to provide a spinning machine that has a fixed yarn-carrying guide.

Another object of the present invention is that the rotation of each spindle is independent with respect to other, meaning each can have its own speed and has its own twisting and winding.

Another object of the present invention is to reduce the power consumption by using individual motors with low power consumption and by eliminating energy losses due to friction of belts.

Another object of the present invention is to reduce system vibrations caused by heavy drive shafts and rubber based belts, which reduces vibration related breakage of the yarn.

Another object of the present invention is to increase the life span of the spindle bearings by eliminating belt related spindle rotation.

Another object of the present invention is to eliminate the vibration of moving rings so that the breakage of the yarn is reduced.

Another object of the present invention is to reduce the tension of the yarn, which reduces yarn breakage, by fixing the ring at one position and moving the spindle reciprocally. This provides an optimum distance between the spindle and drafting rollers. As the ring-carrying guide is fixed, the spinning rate can be held constant, increasing the production of yarn.

Another object of the present invention is to provide a device in which each drafting roller is individually motorized. Motorized drafting rollers allow for flexibility is changing roller speed and ability to create patterns in resulting yarn.

Yet another object of the present invention is to eliminate the main power shaft for controlling the spindle and drafting roller units. And also considerable reduce 'down-time' by making it possible to replace faulty spindle units without affecting production on other spinning units of the same frame.

BRIEF DESCRIPTION OF THE DRAWINGS

In the figures, which illustrate, by way of example only, embodiments of the present invention, FIG. 1 illustrates the principle of ring spinning as adopted in prior art ring spinning frames from (a) the beginning of the cycle, to (b) the end of the cycle;

FIG. 2 illustrates the arrangement of spindles in traditional prior art frame from (a) the beginning of the production cycle and (b) towards the end;

DETAILED DESCRIPTION OF THE DRAWINGS

Figures 3A, 3B:
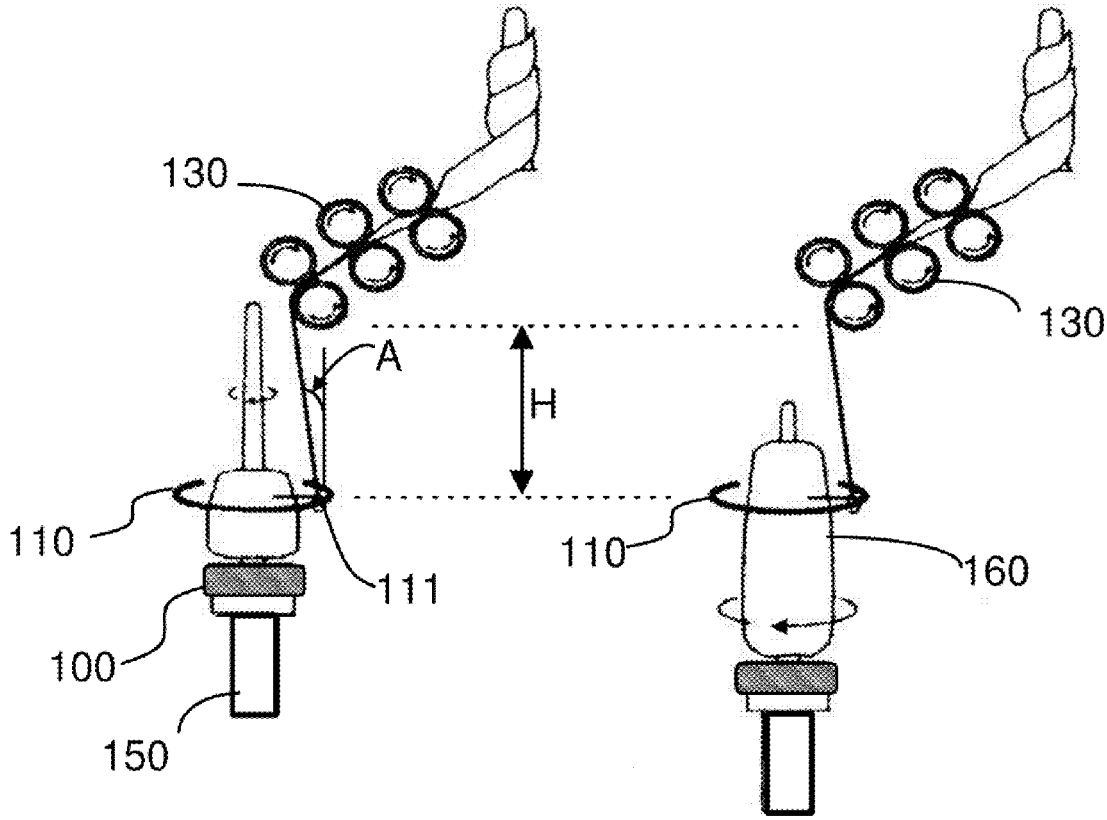
FIG. 3 illustrates the ring spinning mechanism devised in the present invention from the beginning of the cycle (a) to the end of the cycle (b). A spindle motor replaces the belt drives and the main shaft of the frame.

The machine for spinning fibrous material to yarn is referred to as a "spinning frame." FIG. 1*a* and FIG. 1*b* illustrate the principle of the ring spinning as adopted in traditional ring spinning frames. Fibrous material used as the starting material for a spinning frame usually cotton, or cotton based, referred as 'silver' 1, for the purpose of this text. The purpose of a spinning frame is to twist and wind the thick silver into yarn, and wind the yarn onto a spool.

A traditional ring frame is powered by a single electric motor rotating a main power shaft 2 running throughout the length of the frame. The silver 1 is first fed through a series of drafting rollers 3 rotating at different speeds to control the thickness, twist and weight per unit length of the resulting yarn 5. A gearbox, connected to the main power shaft 2 rotates the drafting rollers 3 at fixed speeds. The fixed selection of speeds cannot be changed without manual intervention.

After leaving the drafting rollers 3, the material 5 is guided through a guide 10 carried on a ring 11, passively revolving around the rotating spindle 20. The guide, locates and twist the yarn as it is being wound on the spool 30 mounted on the spindle 20. The ring 11, carrying the guide 10, moves along the length of the spool (up and down) in a reciprocating manner so that the winding is uniform and untangled. The motion of the ring 11 carrying guide 10 is controlled by a cam 15, as illustrated in FIG. 2, powered by the main shaft 2.

The spindle 20 winding the yarn is rotated by a belt 40 connected to the main power shaft 2. All spindles on the spinning frame are, therefore, stopped or rotated together at all times.

All spindles in a traditional frame are mounted on a fixed chassis 50, as illustrated in FIG. 2, while the rings carrying the yarn guides 10 are mounded on a movable chassis operated by a cam 15. In the beginning of the process, the ring 11 carrying the guides 10 starts at the bottom of the spool 30 as illustrated by 60 in FIG. 2*a*. At this point, the distance 70 between the drafting rollers and the guide 10 is too large for the machine to operate at full speed, so the speed is reduced to avoid breakage of the yarn 5. As the spool fills up 31, the cam mechanism moves the ring mounted guide 10 upwards. Spindle speed is increased either manually or electronically as the rings move closer to the drafting rollers 3. Hence, for a large part of the production cycle, the spinning frame runs at much less than its optimum speed, sacrificing productivity.

The new devised mechanism claims to increase productivity, and reduce power consumption, mechanical vibration and material breakage, by the following means.

FIG. 3 and FIG. 4 illustrate a new ring spinning mechanism from (a) the beginning of the cycle to (b) the end of cycle. A spindle motor 100 replaces the belt drives 40 and the main shaft 2 of the frame as was illustrated in FIG. 1. In the present device the rings 110 carrying the guides 111 are located and fixed at an optimum distance H and angle A from the drafting rollers 130. The spindle chassis 150 moves through the ring as the spool 160 fills up.

Motor 100 is connected to the chassis 150 at its lower end. The motor shaft is connected to the spindle. Reciprocating chassis 150 has a cam mechanism (not shown) which moves the motor and spindle system up and down.

As shown in the FIG. 4 the ring spinning frame consists of a drafting unit 200 with multiplicity of drafting rollers 210. Twisting and winding unit 300 for twisting yarn and fleeces and control unit 400 for controlling drafting unit 200 and winding unit 300. The drafting unit 200 includes drafting rollers 210 for drafting the roving's and motor (not shown) for rotatively driving the drafting rollers 210. Drafting rollers 210 are horizontally aligned metal rollers, which rotate at different speeds to control the resulting thickness of the yarn 5. These drafting rollers are individually motorized by motors 220A, 220B, . . . etc.

The twisting and winding unit 300 comprises of spindles 310, rings 320, ring rail 330 and yarn guide 340. Rings 320 are fixed rigidly onto the ring rail 330, resulting in fixation of yarn guide 340. Spindles 310 are horizontal metal rods each having a spool 350 where the resulting yarn 5 from the drafting rollers can be wound. Lower end of the spindle is fixed onto the motor 360.

Each of the spindle motors, as well as roller motors are controlled individually. Each motor, both the spindle motor and the roller motors, are connected to a control unit 400, which consists of a computer 420 loaded with a control software. The control software is a special program to control the speed of each motor which further controls the spindle blades. In addition, the software can control the speed of the drafting motors, therefore controlling the speed of drafting rollers.

Figure 4A:
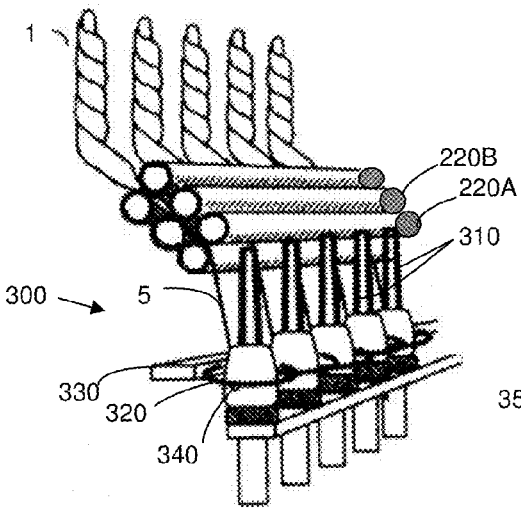
FIG. 4 illustrates the arrangement of spindles in the present ring spinning mechanism from (a) the beginning of the production cycle and (b) towards the end; the power shaft is completely eliminated by individually powering all moving parts, and the reciprocating chassis and the drafting rollers are individually motorized.
Figure 4B:
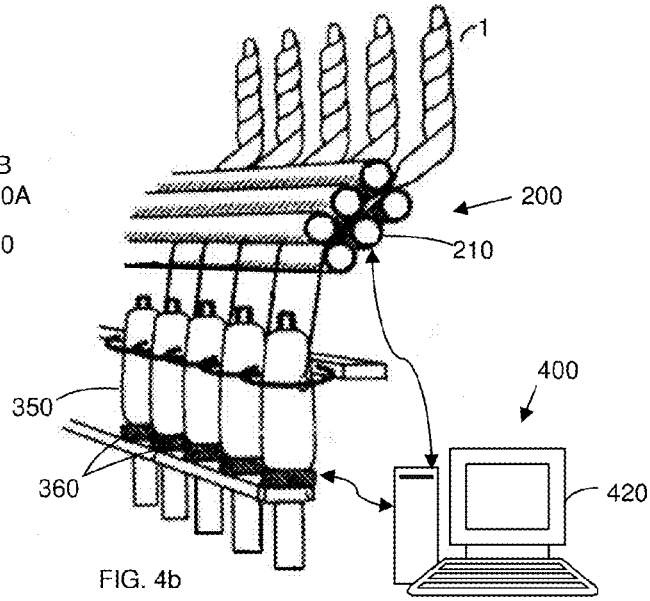

FIG. 1*a* is showing the prevalent system where at the beginning of the cycle the distance between the spinning ring 10 is at its greatest and as spinning takes place it gets to be shorter as in FIG. 1*b*. The present system is shown in FIG. 4*a* and FIG. 4*b*, where at the beginning of cycle, FIG. 4*a*, the distance between the spinning ring 340 remains un-changed even when the spindles are now reaching the end of their cycle. As noted earlier, instead of the ring moving up and down the spindles assembly 350 has actually moved down. This is also called 'spinning geometry'. Ideally this geometry should remain constant as in the present case, but the conventional system cannot achieve this because they cannot move the spindles to fill them where as we are actually moving the spindles to full them.

Each thread count requires a different spinning geometry. Therefore, it cannot be quantified. Normally coarse count need shorter distance and fine counts need longer distance. In conventional machines, some times because of this inability to fix the ring in its vertical movement some counts cannot be made of some spinning machines. Or one can say spinning machines are relatively fixed for making either coarse counts or fine counts. However the present system offers the capability to change this distance according to the need of the count in production and fix it there before beginning of the spinning cycle and it will remain fixed all along thus ensuring consistence of quality. Additionally, the present system will allow any count to be spun on a frame and the frame is not restricted to any one kind of count. In other words our technology is more versatile and allows all counts on the same spinning frame. However in very rare cases where a number of counts are desired on the same thread, the system can be programmed, using the system computer, to vary this geometry during the spinning process. However this is a very special capability which cannot be achieved on current spinning machines.

The present ring spinning machine reduces power consumption by eliminating parasitic power loses. Since the belt drives are removed, there is no belt related friction. In addition, the present device has reduced vibration, allowing for higher speed of operation without vibration related breakage and loss in quality and productivity. This device has increased life of the spindle bearings, by eliminating the constant pull on the spindles by the belt used in the prior art. Spindles can now be individually switched off for any reason (e.g. breakage, re-loading, partial production).

The fixed ring location and the moving spindle mechanism provides several advantages including: Optimum geometry and distance achieved at all times, increasing yarn quality; vibration of the moving ring is not induced into the yarn since the ring is fixed, thus improving quality, and reducing risk of breakage; as the ring carrying the guide is fixed, the process can operate at a constant full speed, increasing productivity; reduced downtime between switching to different types of yarn, since the speed of the rollers can be changed instantly; and the roller speeds can be changed at runtime in order to create patterns in the resulting yarn.

What is claimed is:

1. A ring spinning machine, comprising:

a. a drafting unit, a twisting and winding unit for twisting yarn and fleeces, and a control unit;

b. said drafting unit comprising:

i. a series of horizontally aligned drafting rollers rotating at different speeds to control the thickness, twist and weight per unit length of a yarn;

ii. said drafting rollers being individually motorized by controllable roller motors to control the speed of the rollers;

c. said twisting and winding unit comprising:

i. spindles, rings, ring rails, yarn guides and a reciprocating chassis;

ii. said rings rigidly connected to the ring rail;

iii. said ring rail fixed in place and location relative to the drafting unit;

iv. each said spindle being a vertical rod having a spool, whereby the resulting yarn from the drafting rollers winds on the spool;

v. each said spindle arranged coaxially in an inside space of a ring;

vi. each said ring having a ring guide, passively revolving around a rotating spindle, whereby the yarn after leaving the drafting rollers is guided through the guide carried on the ring, locating and twisting the yarn as it winds on the spool;

vii. each said spindle having an individual controllable spindle motor to control the speed of the spindle;

viii. said spindles and spindle motors fixed on a chassis;

ix. said chassis connected to a cam providing a reciprocating up and down motion to the chassis, thereby, moving the spindles in a reciprocating up and down motion, and thereby said spindles go through the rings in an up and down motion as the spools fill up;

whereby, the ring guides move in a circular motion in a constant plane, while the spools pass through the rings in a reciprocating up and down motion so that the winding is uniform and untangled, and whereby the rotating speed of each spindle can be controlled individually to reduce breakage of the yarn.

2. A ring spinning machine of claim 1, wherein said control unit is a programmable computer to control the speed of individual roller motors and spindle motors.

3. A ring spinning machine of claim 1, wherein each said spindle motor having a top and a bottom, wherein said bottom connected to the chassis, and said top connected to a spindle.

4. A ring spinning machine of claim 1, wherein said ring rail fixed location relative to the drafting unit defines a distance H, said distance chosen to provide a defined thread count and to minimize the breakage of the yarn.

5. A ring spinning machine of claim 1, wherein said ring rail fixed location relative to the drafting unit defines an angle A between the yarn and a vertical axis, said angle chosen provide a defined thread count and to minimize the breakage of the yarn.

6. A ring spinning machine of claim 1, wherein each said spindle having a constant speed of rotation from the start to the end of winding.

* * * * *